United States Patent [19]

Cook

[11] Patent Number: 4,951,637

[45] Date of Patent: Aug. 28, 1990

[54] PURGE FLOW REGULATOR

[75] Inventor: John E. Cook, Chatham, Canada

[73] Assignee: Siemens-Bendix Automotive Electronics Limited, Chatham, Canada

[21] Appl. No.: 373,757

[22] Filed: Jun. 29, 1989

[51] Int. Cl.[5] ..... F02M 39/00

[52] U.S. Cl. ..... 123/520; 123/519; 123/463

[58] Field of Search ..... 123/520, 521, 519, 518, 123/516, 463

[56] References Cited

U.S. PATENT DOCUMENTS

| | | | |
|---|---|---|---|
| 3,752,134 | 8/1973 | Hollis | 123/520 |
| 4,700,683 | 10/1987 | Uranishi | 123/520 |
| 4,703,737 | 11/1987 | Cook | 123/518 |
| 4,741,317 | 5/1988 | Yost | 123/520 |
| 4,783,962 | 11/1988 | Grein | 123/520 |
| 4,809,667 | 3/1989 | Uranishi | 123/520 |

FOREIGN PATENT DOCUMENTS

| | | | |
|---|---|---|---|
| 0041443 | 3/1982 | Japan | 123/520 |

*Primary Examiner*—Carl Stuart Miller

*Attorney, Agent, or Firm*—George L. Boller; Russel C. Wells

[57] ABSTRACT

Hydrocarbon fuel vapors that are collected in a canister are periodically purged to the intake manifold through a purge valve that comprises a variable orifice valve portion and a flow regulator valve portion in series with each other. The variable orifice portion sets an orifice in inverse proportion to manifold vacuum. The flow regulator portion controls the flow in accordance with a signal from the engine E.C.U.

8 Claims, 2 Drawing Sheets

PURGE FLOW REGULATOR

BACKGROUND AND SUMMARY OF THE INVENTION

This invention relates to evaporative emission control systems of the type that are commonly used on automotive vehicles for the purpose of minimizing the emission of hydrocarbon fuel vapors to the atmosphere.

A typical evaporative emission control system functions to collect hydrocarbon vapors in a canister and periodically purge the canister by venting the accumulated vapors to the intake manifold of the engine for subsequent combustion in the engine combustion chambers. Purging of the canister occurs periodically whenever conditions that are conducive to purging exist. Purging is conducted through a purge valve. A common type of purging control comprises the use of an electrically actuated valve to control the extent to which the vapors are allowed to pass to the intake manifold. The electrically actuated valve is under the control of a signal from the engine electronic control unit. The signal from the electronic control unit modulates a pulse width modulated signal to the solenoid valve such that the amount of purging that is permitted by the purge valve is controlled in accordance with certain engine operating conditions.

The present invention relates to a new and improved evaporative emission control system in which the purging process is better adapted to engine operating conditions. Rather than endeavoring to accomplish complete control of purging by means of a solenoid actuated valve, the present invention comprises a purge valve in which the regulating valve portion is preceded by a variable orifice valve portion. The variable orifice valve portion sets an orifice size that is in inverse relation to the magnitude of a manifold vacuum. The cooperative effect of the two valve portions of the purge valve is such that the flow through the purge valve as a function of the percentage duty cycle that is applied to the purge valve by the electronic vacuum regulator is defined by a series of graph plots each of which is defined by a particular magnitude of manifold vacuum. As a result, better control of canister purging is obtained and this has a special advantage during light engine load conditions (when intake manifold vacuum levels are high).

The foregoing features, advantages and benefits of the invention, along with additional ones, will be seen in the ensuing description and claims which should be considered in conjunction with the accompanying drawings. The drawings disclose a preferred embodiment of the invention according to the best mode contemplated at the present time in carrying out the invention.

DESCRIPTION OF THE PREFERRED EMBODIMENT

Figure 1:
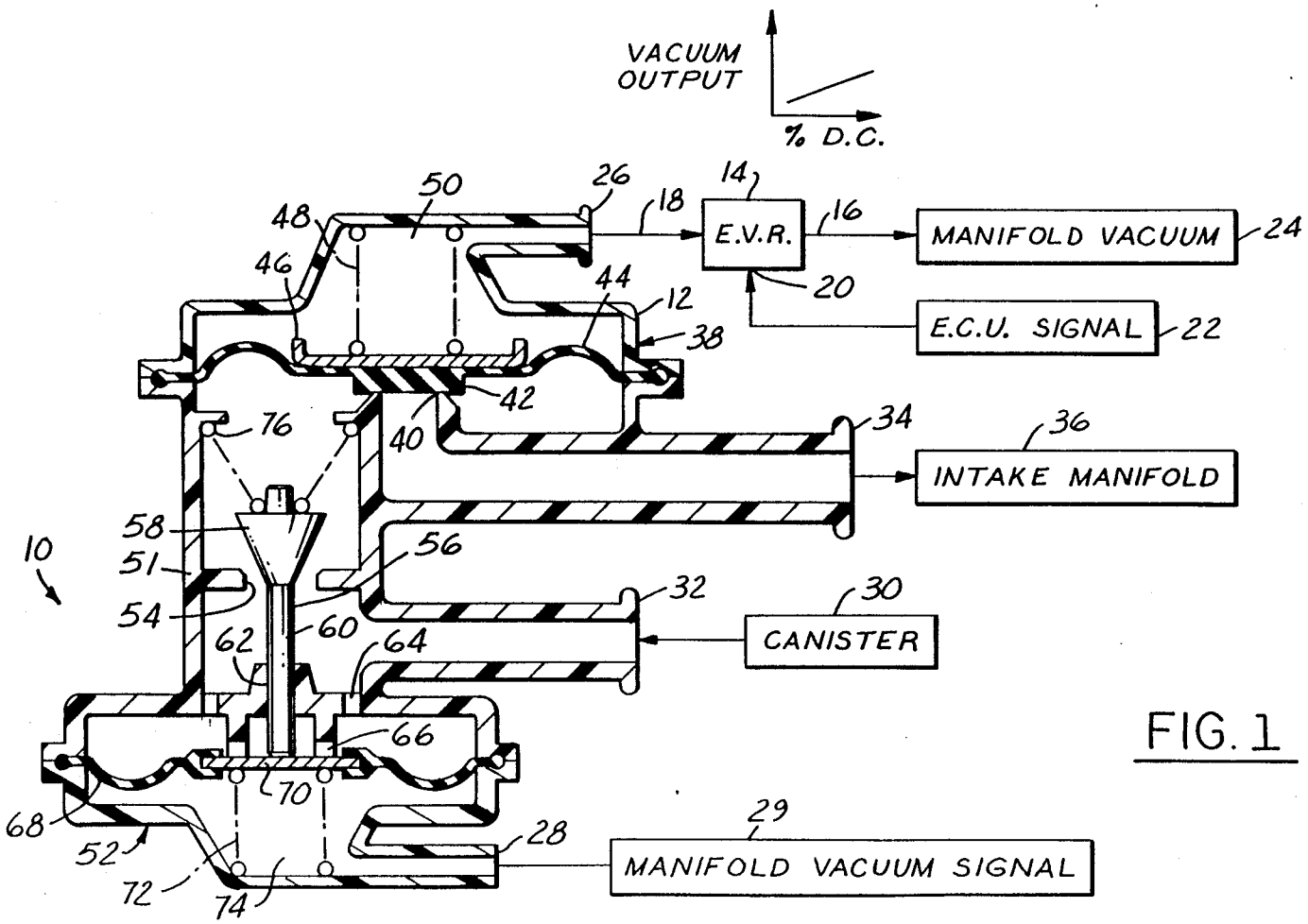
FIG. 1 is a view, partly in cross-section, of an evaporative emission control system, including purge valve, in accordance with principles of the present invention.

FIG. 1 shows an evaporative emission control system 10 in accordance with principles of the invention and comprising a purge valve 12 and an electronic vacuum regulator 14. Electronic vacuum regulator 14 comprises a vacuum input 16, a vacuum output 18, and an electrical signal input 20. The electrical signal input 20 is connected to receive a control signal from the engine ECU 22. This signal is a function of one or more parameters associated with engine operation. Inlet 16 in connected to engine manifold vacuum 24 while outlet 18 is connected to a control port 26 of purge valve 12. Purge valve 12 has another control port 28 that is connected to receive a manifold vacuum signal 29. The canister 30 that collects hydrocarbon emissions is connected to an inlet port 32 of purge valve 12 while an outlet port 34 of purge valve 12 is connected to intake manifold 36.

Purge valve 12 further comprises a flow regulator portion 38. A circular valve seat 40 is fashioned upstream of outlet port 34 and a valve element in the form of a circular disc 42 coacts with seat 40 to regulate the flow through purge valve 12 to outlet 34. Disc 42 is affixed to the central region of one face of a diaphragm 44. The opposite face of the diaphragm contains a retainer 46, and a coil spring 48 acts on the retainer to urge the diaphragm in such a manner that disc 42 is urged into closure with seat 40. It can be seen in FIG. 1 that diaphragm 44 forms a movable wall of a vacuum chamber 50 that is communicated by control port 26 to electronic vacuum regulator 14.

In the absence of vacuum being applied to chamber 50 spring 48 urges retainer 46 and diaphragm 44 downwardly in FIG. 1 to cause disc 42 to close on seat 40. In this condition there can be no flow through the valve body 51 from inlet port 32 to outlet port 34. When vacuum is applied to control chamber 50 by electronic vacuum regulator 14, a pressure differential will be created across the diaphragm causing disc 42 to unseat from seat 40 in an amount that is related to the intensity of the vacuum that is delivered to chamber 50.

Purge valve 12 further comprises a variable orifice valve portion 52 that is eccentric to disc 42. Portion 52 comprises an orifice 54 that is downstream from inlet port 32. A valve 56 coacts with orifice 54 and comprises a tapered valve head 58 and a stem 60. Stem 60 is guided for linear motion axially of orifice 54 by means of a valve stem guide 62. Openings 64 and 66 are provided in the valve stem guide, as shown, to communicate the pressure from inlet port 32 to the upper face of a diaphragm 68. The central portion 70 of diaphragm 68 is a non-resilient bearing surface against which the lower end of valve stem 60 bears. It is to be observed that this lower end of the valve stem is rounded.

The variable orifice valve portion 52 further comprises a helical coil spring 72 that is disposed within a vacuum chamber 74 on the side of diaphragm 68 opposite valve 56. This chamber 74 is communicated by control port 28 to the manifold vacuum signal 29. In the condition shown in FIG. 1 no vacuum is being applied to chamber 74 and therefore spring 72 biases diaphragm 68 to the maximum upward position wherein the non-resilient portion 70 bears against the lower end of guide 62. In this position the smallest diameter portion of valve head 58 is disposed in orifice 54 so that the net flow area through the orifice is a maximum. As increasing vacuum is applied to chamber 74, diaphragm 68 is moved increasingly downwardly and valve 56 follows. A spring 76, that is much lighter than spring 72, acts against the upper end of the valve head 58 to cause the valve 56 to be maintained in contact with the non-resilient portion 70 of diaphragm 68 so that valve 56 will always follow the motion of diaphragm 68. With increasing vacuum in chamber 74, the increasing diameter of valve head 58 is progressively disposed in orifice 54 thereby progressively restricting the orifice. When the valve has been displaced to its maximum downward position, the net effective opening through orifice 54 is a minimum.

The function of valve head 58 is to control orifice 54 such that the net effective area through the orifice is inversely proportional to manifold vacuum. The function of valve portion 38 is to control the degree of unseating of valve 42 from seat 40 in accordance with the ECU control signal 22 as delivered to control chamber 50 by the electronic vacuum regulator 14. It can be seen that the electronic vacuum regulator has a characteristic wherein it modulates the vacuum that is supplied from manifold vacuum 24 such that the vacuum output that is delivered to chamber 50 is correlated with the duty cycle of signal 22.

Figure 2:
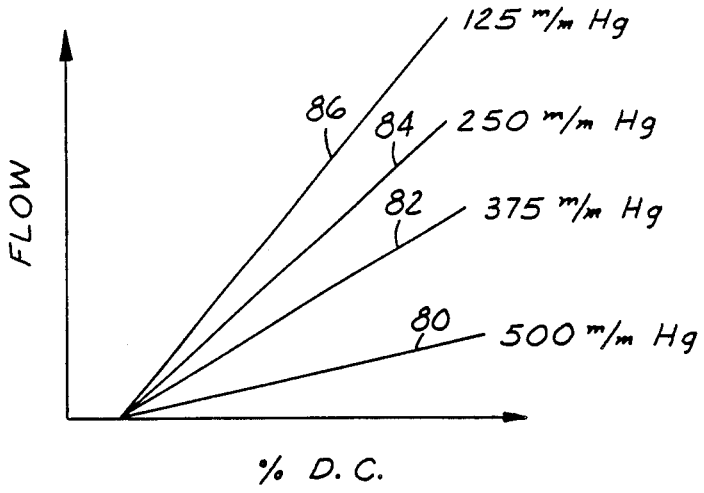
FIG. 2 is a graph useful in explaining the operation of the system of FIG. 1.

Hence the flow through purge valve 12 from inlet 32 through orifice 54 through valve seat 40 to outlet 34 is a function of both the ECU signal 22 and the manifold vacuum signal 29. The relationship is graphically portrayed in FIG. 2 where the four graphs 80,82,84 and 86 reflect the valve operating characteristics for four different levels of manifold vacuum signal 29, namely 500mm mercury, 375mm mercury, 250mm mercury, 125mm mercury. If the manifold vacuum signal 29 is at 500mm mercury, the valve 12 will operate in accordance with the graph 80 whereby the percent duty cycle of the ECU signal 22 will cause a corresponding flow through valve 12 Similarly for the other graph plots. It will be appreciated that there are a whole series of graph plots such as those 80,82,84,86 depending upon the particular magnitude of manifold vacuum signal 29.

Stated another way, valve portion 52 establishes a basic setting for the purge valve 12 over which the valve will operate by the ECU signal 22. Of course, changes in manifold vacuum signal 29 will change this basic setting.

The evaporative emission control system of the present invention provides better control over the venting of the canister to the intake manifold and this is particularly important at high engine manifold vacuums where the flow into the engine may be relatively low. As can be appreciated from the series of graphs shown in FIG. 2, greater purging flow of the canister is permitted as there is increased air flow into the intake manifold.

While a preferred embodiment of the invention has been disclosed, it will be appreciated the principles are applicable to other embodiments.

What is claimed is:

1. An evaporative emission control system for purging a collection canister of hydrocarbon vapors by venting the collection canister to the intake manifold of an internal combustion engine, said system comprising:

a flow path from the canister to the intake manifold, said flow path containing, in series, a variable orifice whose size is controlled in inverse relation to the magnitude of manifold vacuum, and a flow regulator that is controlled according to one or more variable parameters associated with operation of the engine;

in which the variable orifice is located in said flow path upstream of said flow regulator and is controlled in inverse relation to the magnitude of manifold vacuum by a means for referencing manifold vacuum against the pressure sensed at a location in said flow path that lies between said variable orifice and the collection canister.

2. A system as set forth in claim 1 in which the flow regulator is controlled by an electronic signal from an engine electronic control unit acting via an electronic vacuum regulator.

3. A canister purge flow regulator valve for purging a collection canister of hydrocarbon vapors by venting the collection canister to the intake manifold of an internal combustion engine, said purge flow regulator valve comprising:

a valve body, an inlet port for connection to a canister, an outlet port for connection to an engine intake manifold, a flow path through said body between said inlet and outlet ports, a variable orifice valve portion and a flow regulator valve portion in said flow path located in series with each other, a vacuum actuator for selectively operating said variable orifice valve portion in accordance with a manifold vacuum signal, and a second vacuum actuator for selectively operating said flow regulator valve portion in accordance with one or more variable parameters associated with operation of the engine as applied to said second vacuum actuator via an electric vacuum regulator.

4. A purge flow regulator valve as set forth in claim 3 in which said variable orifice valve portion comprises a valve member having a stem and a head, said body comprising a stem guide for guiding the stem of said valve member for linear motion, said first vacuum actuator comprises a diaphragm including a spring that acts on the head of said valve member to keep said stem in contact with said diaphragm.

5. A purge flow regulator valve as set forth in claim 4 in which said flow regulator valve portion comprises a disc affixed to a central region of a diaphragm of said second vacuum actuator and the linear motion of said valve member is along a line that is eccentric to said disc.

6. In the fuel vapor collection system of a hydrocarbon fueled automotive vehicle engine wherein a canister that collects hydrocarbon vapors is purged by venting to the engine intake manifold under conditions conducive to purging so that the vapors can be subsequently combusted by the engine, the improvement comprising:

a canister purge flow regulator valve comprising a valve body having an inlet port, means connecting said inlet port to said canister for the conveyance of fuel vapors from the canister into the valve body, said valve body also having an outlet port, means connecting said outlet port to the engine intake manifold for the conveyance of fuel vapors out of said body to the intake manifold, a flow path through said body between said inlet and outlet ports, a variable orifice valve portion and a flow regulator valve portion located in said flow path in series with each other, a vacuum actuator for selectively operating said variable orifice valve portion in accordance with a signal indicative of intake manifold vacuum, and a second vacuum actuator for selectively operating said flow regulator valve portion in accordance with one or more variable parameters associated with operation of the engine; and an electronic vacuum regulator for applying to said second vacuum actuator a vacuum signal that is a function of said one or more variable parameters associated with operation of the engine to thereby operate said flow regulator valve portion in accordance with said one or more variable parameters.

7. The improvement set forth in claim 6 in which said variable orifice valve portion is located in said flow path upstream of said flow regulator valve portion and is controlled in inverse relation to the magnitude of intake manifold vacuum by a means for referencing intake manifold vacuum against the pressure sensed at a location in said flow path that lies between said variable orifice valve portion and said canister.

8. An evaporative emission control system for purging a collection canister of hydrocarbon vapors by venting the collection canister to the intake manifold of an internal combustion engine, said system comprising:

a flow path from the canister to the intake manifold, said flow path containing, in series, a variable orifice whose size is controlled in inverse relation to the magnitude of manifold vacuum, and a flow regulator that is controlled according to one or more variable parameters associated with operation of the engine;

including a vacuum actuator for selectively operating said variable orifice in accordance with a signal indicative of intake manifold vacuum, and a second vacuum actuator for selectively operating said flow regulator in accordance with one or more variable parameters associated with operation of the engine.

* * * * *